US007004814B2

(12) United States Patent
Chen et al.

(10) Patent No.: US 7,004,814 B2
(45) Date of Patent: Feb. 28, 2006

(54) CMP PROCESS CONTROL METHOD

(75) Inventors: Chen-Shien Chen, Hsin-Chu (TW); Yai-Yei Huang, Hsin-Chu (TW); Yean-Zhaw Chen, Tainan (TW); Kai-Hsiung Chen, Danshuei Township, Taipei County (TW); Yih-Shung Lin, Singapore (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 119 days.

(21) Appl. No.: 10/804,934

(22) Filed: Mar. 19, 2004

(65) Prior Publication Data

US 2005/0208876 A1 Sep. 22, 2005

(51) Int. Cl.
*B24B 1/00* (2006.01)

(52) U.S. Cl. ..... 451/5; 451/10; 451/11; 451/41; 438/692; 156/345.12

(58) Field of Classification Search ..... 451/5, 451/9, 10, 11, 41, 285, 287, 288; 438/692, 438/693; 156/345.11, 345.12, 345.13
See application file for complete search history.

(56) References Cited

U.S. PATENT DOCUMENTS 6,171,174 B1 * 1/2001 Campbell et al. ..... 451/5
6,439,964 B1 * 8/2002 Prahbu et al. ..... 451/8
6,530,822 B1 * 3/2003 Lin ..... 451/11
6,531,399 B1 * 3/2003 Kojima et al. ..... 438/692
6,648,728 B1 * 11/2003 Kojima et al. ..... 451/5
6,682,398 B1 * 1/2004 Meyer ..... 451/5
6,723,144 B1 * 4/2004 Katagiri et al. ..... 51/308
6,726,534 B1 * 4/2004 Bogush et al. ..... 451/36
6,727,107 B1 * 4/2004 Dunton et al. ..... 438/14
6,743,075 B1 * 6/2004 Lin et al. ..... 451/5
6,746,958 B1 * 6/2004 Hewett et al. ..... 438/687
6,913,516 B1 * 7/2005 Wang et al. ..... 451/11
6,914,000 B1 * 7/2005 Kamada ..... 438/692

FOREIGN PATENT DOCUMENTS

JP 10202508 * 8/1998

* cited by examiner

*Primary Examiner*—Eileen P. Morgan
(74) *Attorney, Agent, or Firm*—Tung & Assoc

(57) ABSTRACT

A one-time feedback CMP process control method which contributes to uniformity in the quantity of material removed from wafers in a lot during semiconductor processing and is suitable for complex processes such as STI (shallow trench isolation) fabrication procedures, is disclosed. The method includes providing a plurality of wafers having a set of pilot wafers and a set of remaining wafers, polishing each of the pilot wafers according to an original process time, determining a compensation time for the pilot wafers, determining an update time by adding the compensation time to the original process time and polishing the set of remaining wafers according to the update time.

23 Claims, 4 Drawing Sheets

CMP PROCESS CONTROL METHOD

FIELD OF THE INVENTION

The present invention relates to chemical mechanical polishing apparatus for polishing semiconductor wafer substrates. More particularly, the present invention relates to an improved CMP process control method which includes a one-time polishing time feedback adjustment for all wafers in a lot to facilitate greater between-wafer uniformity in the quantity of material removed from the wafers in a CMP process.

BACKGROUND OF THE INVENTION

In the fabrication of semiconductor devices from a silicon wafer, a variety of semiconductor processing equipment and tools are utilized. One of these processing tools is used for polishing thin, flat semiconductor wafers to obtain a planarized surface. A planarized surface is highly desirable on a shadow trench isolation (STI) layer, inter-layer dielectric (ILD) or on an inter-metal dielectric (IMD) layer, which are frequently used in both memory and logic devices. The planarization process is important since it enables the subsequent use of a high-resolution lithographic process to fabricate the next-level circuit. The accuracy of a high resolution lithographic process can be achieved only when the process is carried out on a substantially flat surface. The planarization process is therefore an important processing step in the fabrication of semiconductor devices.

A global planarization process can be carried out by a technique known as chemical mechanical polishing, or CMP. The process has been widely used on STI, ILD or IMD layers in fabricating modern semiconductor devices. A CMP process is performed by using a rotating platen in combination with a polishing head. The process is used primarily for polishing the front surface or the device surface of a semiconductor wafer for achieving planarization and for preparation of the next level processing. A wafer is frequently planarized one or more times during a fabrication process in order for the top surface of the wafer to be as flat as possible. A wafer can be polished in a CMP apparatus by being placed on a carrier and pressed face down on a polishing pad covered with a slurry of fumed, colloidal silica, aluminum, or CeO2.

A polishing pad used on a rotating platen is typically constructed in two layers overlying a platen, with a resilient layer as an outer layer of the pad. The layers are typically made of a polymeric material such as polyurethane and may include a filler for controlling the dimensional stability of the layers. A polishing pad is typically made several times the diameter of a wafer in a conventional rotary CMP, while the wafer is kept off-center on the pad in order to prevent polishing of a non-planar surface onto the wafer. The wafer itself is also rotated during the polishing process to prevent polishing of a tapered profile onto the wafer surface. The axis of rotation of the wafer and the axis of rotation of the pad are deliberately not collinear; however, the two axes must be parallel. It is known that uniformity in wafer polishing by a CMP process is a function of pressure, velocity and concentration of the slurry used.

A CMP process is frequently used in the planarization of an STI, ILD or IMD layer on a semiconductor device. Such layers are typically formed of a dielectric material. A most popular dielectric material for such usage is silicon oxide. In a process for polishing a dielectric layer, the goal is to remove typography and yet maintain good uniformity across the entire wafer. The amount of the dielectric material removed is normally between about 2000 A and about 10,000 A. The uniformity requirement for STI, ILD or IMD polishing is very stringent since non-uniform dielectric films lead to poor lithography and resulting window-etching or plug-formation difficulties. The CMP process has also been applied to polishing metals, for instance, in tungsten plug formation and in embedded structures. A metal polishing process involves a polishing chemistry that is significantly different than that required for oxide polishing.

Important components used in CMP processes include an automated rotating polishing platen and a wafer holder, which both exert a pressure on the wafer and rotate the wafer independently of the platen. The polishing or removal of surface layers is accomplished by a polishing slurry consisting mainly of fumed, colloidal silica or CeO2 suspended in deionixed water or alkali solution. The slurry is frequently fed by an automatic slurry feeding system in order to ensure uniform wetting of the polishing pad and proper delivery and recovery of the slurry. For a high-volume wafer fabrication process, automated wafer loading/unloading and a cassette handler are also included in a CMP apparatus.

As the name implies, a CMP process executes a microscopic action of polishing by both chemical and mechanical means. While the exact mechanism for material removal of an oxide layer is not known, it is hypothesized that the surface layer of silicon oxide is removed by a series of chemical reactions which involve the formation of hydrogen bonds with the oxide surface of both the wafer and the slurry particles in a hydrogenation reaction; the formation of hydrogen bonds between the wafer and the slurry; the formation of molecular bonds between the wafer and the slurry; and finally, the breaking of the oxide bond with the wafer or the slurry surface when the slurry particle moves away from the wafer surface. It is generally recognized that the CMP polishing process is not a mechanical abrasion process of slurry against a wafer surface.

While the CMP process provides a number of advantages over the traditional mechanical abrasion type polishing process, a serious drawback for the CMP process is the difficulty in controlling polishing rates at different locations on a wafer surface. Since the polishing rate applied to a wafer surface is generally proportional to the relative rotational velocity of the polishing pad, the polishing rate at a specific point on the wafer surface depends on the distance from the axis of rotation. In other words, the polishing rate obtained at the edge portion of the wafer that is closest to the rotational axis of the polishing pad is less than the polishing rate obtained at the opposite edge of the wafer. Even though this is compensated for by rotating the wafer surface during the polishing process such that a uniform average polishing rate can be obtained, the wafer surface, in general, is exposed to a variable polishing rate during the CMP process.

Recently, a chemical mechanical polishing method has been developed in which the polishing pad is not moved in a rotational manner but instead, in a linear manner. It is therefore named as a linear chemical mechanical polishing process, in which a polishing pad is moved in a linear manner in relation to a rotating wafer surface. The linear polishing method affords a more uniform polishing rate across a wafer surface throughout a planarization process for the removal of a film layer from the surface of a wafer. One added advantage of the linear CMP system is the simpler construction of the apparatus, and this not only reduces the cost of the apparatus but also reduces the floor space required in a clean room environment.

A typical conventional CMP apparatus 90 is shown in FIG. 1 and includes a base 100; polishing pads 210*a*, 210*b*, and 210*c* provided on the base 100; a head clean load/unload (HCLU) station 360 which includes a load cup 300 for the loading and unloading of wafers (not shown) onto and from, respectively, the polishing pads; and a head rotation unit 400 having multiple polishing pads 410*a*, 410*b*, 410*c* and 410*d* for holding and fixedly rotating the wafers on the polishing pads.

The three polishing pads 210*a*, 210*b* and 210*c* facilitate simultaneous processing of multiple wafers in a short time. Each of the polishing pads is mounted on a rotatable carousel (not shown). Pad conditioners 211*a*, 211*b* and 211*c* are typically provided on the base 100 and can be swept over the respective polishing pads for conditioning of the polishing pads. Slurry supply arms 212*a*, 212*b* and 212*c* are further provided on the base 100 for supplying slurry to the surfaces of the respective polishing pads.

The polishing heads 410*a*, 410*b*, 410*c* and 410*d* of the head rotation unit 400 are mounted on respective rotation shafts 420*a*, 420*b*, 420*c*, and 420*d* which are rotated by a driving mechanism (not shown) inside the frame 401 of the head rotation unit 400. The polishing heads hold respective wafers (not shown) and press the wafers against the top surfaces of the respective polishing pads 210*a*, 210*b* and 210*c*. In this manner, material layers are removed from the respective wafers. The head rotation unit 400 is supported on the base 100 by a rotary bearing 402 during the CMP process.

The load cup 300 is detailed in FIG. 1 and includes a pedestal support column 312 that supports a circular pedestal 310 on which the wafers are placed for loading of the wafers onto the polishing pads 210*a*, 210*b* and 210*c*, and unloading of the wafers from the polishing pads. A pedestal film 313 is typically provided on the upper surface of the pedestal 310 for contacting the patterned surface (the surface on which IC devices are fabricated) of each wafer. Fluid openings 314 extend through the pedestal 310 and pedestal film 313. The bottom surfaces of the polishing heads 410*a*, 410*b*, 410*c* and 410*d* and the top surface of the pedestal film 313 are washed at the load cup 300 by the ejection of washing fluid through the fluid openings 314.

In typical operation, the CMP apparatus 90 is used to remove material from a layer (not shown) on each wafer in order to reduce the thickness of the layer to a desired target thickness. Accordingly, the pre-CMP thickness of the layer is initially measured, and the estimated polish time and polish recipe, along with the target thickness for the layer on each wafer, are programmed into a CLC (closed-loop controller) 1, shown in FIG. 2. Each wafer is mounted on a polishing head 410*a*, 410*b*, 410*c* or 410*d* and sequentially polished against the polishing pads 210*a*, 210*b* and 210*c*, respectively, of the CMP apparatus 90. The polishing pads progressively remove material from and reduce the thickness of the layer on the wafer. The polishing process is shown in FIG. 2, wherein S1 indicates the first polishing step on the polishing pad 210*a*; S2 indicates the second polishing step on the polishing pad 210*b*; and S3 indicates the third polishing step on the polishing pad 210*c*. The CLC 1 controls the polish time and other aspects of the polishing recipe at each polishing step in the sequence. After the polishing sequence is completed the wafer may be subjected to post-CMP cleaning, as indicated in step S4.

After post-CMP cleaning, the wafer may be subjected to in-line metrology, as indicated in step S5, to measure the post-CMP thickness of the polished layer. The post-CMP thicknesses of the layers among the wafers in a given wafer lot have a tendency to vary somewhat from each other, due to the inherent differences in the material removal rate from one polishing sequence to another. Accordingly, the measured post-CMP thickness of the layer on each wafer is transmitted as a feedback signal 2 to the CLC 1, which uses the pre-CMP thickness, post-CMP thickness and polish time for each wafer to calculate the material removal rate for the layer on the wafer. The CLC 1 then uses the calculated material removal rate for the wafer to adjust the polishing time for the next wafer to be polished at the polishing steps S1–S3. Accordingly, a feedback adjustment to the polish time is made to the process recipe for each successive wafer in a wafer lot, and is based on the material removal rate calculated for the layer on the previous wafer. This continuous feedback for each wafer in the lot contributes to uniformity in the quantity of material removed from the layers among the multiple wafers in the lot.

The continuous feedback mechanism described above is based on a single-variable (material removal rate) algorithm and is suitable for CMP applications in which material is removed from a single layer on a wafer. However, the continuous feedback mechanism is unsuitable for more complex processes, such as STI (shallow trench isolation) CMP processes. In an STI CMP process, three variables must be taken into account when calculating the proper material removal rate: the trench depth, the HDP oxide thickness and the SiN thickness. Use of the single-variable continuous feedback mechanism in an STI CMP process frequently causes over-prediction and over-adjustment to the material removal rate for succeeding wafers in a lot. Accordingly, an improved method for controlling a CMP process is needed.

An object of the present invention is to provide an improved CMP process control method.

Another object of the present invention is to provide an improved, one-time feedback CMP process control method which contributes to uniformity in the quantity of material removed from wafers in a lot during semiconductor processing.

Still another object of the present invention is to provide a one-time feedback CMP process control method which is suitable for complex processes such as STI (shallow trench isolation) fabrication procedures.

Yet another object of the present invention is to provide an improved one-time feedback CMP process control method which eliminates or substantially reduces run-to-run process variations in a CMP process.

A still further object of the present invention is to provide an improved, one-time feedback CMP process control method which includes a one-time polishing time feedback adjustment for all wafers in a lot to facilitate greater between-wafer uniformity in the quantity of material removed from the wafers in a CMP process.

Yet another object of the present invention is to provide an improved CMP process control method which is characterized by precise adjustment in the process time and material removal rate in the chemical mechanical polishing of wafers.

A still further object of the present invention is to provide an improved CMP process control method which may include the polishing of pilot wafers in a lot to determine the divergence of the thickness of each wafer from a target thickness and the material removal rate of each polishing head in the apparatus; calculating a compensation time using the average divergence and the average material removal rate; calculating an update time by adding the compensation time to the original process time; and polishing the remaining wafers in the lot according to the update time.

Yet another object of the present invention is to provide an improved CMP process control method which in one embodiment includes determining a compensation time for each of multiple polishing heads or wafer carriers in a CMP apparatus using pilot wafers in a lot; calculating an update process time for each polishing head by adding the original process time to the compensation time for the polishing head; and processing remaining wafers in the lot using the update process time.

SUMMARY OF THE INVENTION

In accordance with these and other objects and advantages, the present invention generally relates to an improved, one-time feedback CMP process control method which contributes to uniformity in the quantity of material removed from wafers in a lot during semiconductor processing and is suitable for complex processes such as STI (shallow trench isolation) fabrication procedures. According to one embodiment of the method, a pre-CMP thickness of each of multiple pilot wafers in a wafer lot is initially measured. The pilot wafers are then polished according to a default or given process recipe having a process time which is ordinarily used for the CMP process. After the CMP polishing sequence is completed, the post-CMP thickness of each pilot wafer is measured. Both the divergence of the post-CMP thickness of each wafer from a target thickness and the material removal rate of each polishing head in the apparatus are then determined.

According to an "average mode" of the CMP process control method, the average divergence between the post-CMP thicknesses and the target thicknesses of the pilot wafers, as well as the average material removal rate for the polishing heads, are determined. A compensation time is then calculated using the average divergence and the average material removal rate. An update time is calculated by adding the compensation time to the original process time. The remaining wafers in the lot are then polished according to the update time.

According to an "individual head mode" of the CMP process control method, the divergence between the target thickness and the post-CMP thickness produced by each of the multiple polishing heads in the CMP apparatus is determined. The material removal rate of each polishing head is also determined. Using the divergence and the material removal rate for each polishing head, a compensation time is calculated for each polishing head. An update time for each polishing head is calculated by adding the compensation time to the original process time for that polishing head. The remaining wafers in the lot are then processed using the calculated update time for each of the polishing heads.

Both the "average mode" and the "individual head mode" of the one-time feedback CMP process control method of the present invention can be carried out according to either a lot-based mode or a continuing mode. According to the lot-based mode, multiple pilot wafers in a lot are used to calculate the compensation time for the "average mode" or the "individual head mode", which is then implemented for the remaining wafers in the lot. Upon CMP processing of a new wafer lot, pilot wafers from that lot are then used to calculate a new compensation time only for the remaining wafers in the lot, and another compensation time is calculated for the wafers in the next lot.

According to the continuing mode, multiple pilot wafers in a lot are used to calculate the compensation time for the "average mode" or the "individual mode", which is implemented both for the remaining wafers in that lot and for some or all of the wafers in the next lot. A new compensation time is periodically calculated after numerous wafers in successive lots have been processed. The pilot wafers for the new compensation time may be selected from the beginning, middle or end of a lot.

BRIEF DESCRIPTION OF THE DRAWINGS

The invention will now be described, by way of example, with reference to the accompanying drawings, in which.

DETAILED DESCRIPTION OF THE INVENTION

The present invention contemplates a one-time feedback CMP process control method which is used to polish each of successive wafers in one or more wafer lots, typically in the fabrication of semiconductor integrated circuits on the wafers. The method includes a one-time, rather than a continuous, feedback or update polish time adjustment to the polishing heads on the CMP apparatus for each of the successive wafers in the wafer lot. The update polish time adjustment is first obtained by processing multiple pilot wafers and is then used to polish the remaining wafers in the lot or in successive lots. The method contributes to uniformity in the quantity of material removed from wafers in a wafer lot during chemical mechanical polishing of the wafers. The method is suitable for complex processes such as STI (shallow trench isolation) fabrication procedures, for example.

Figure 6:
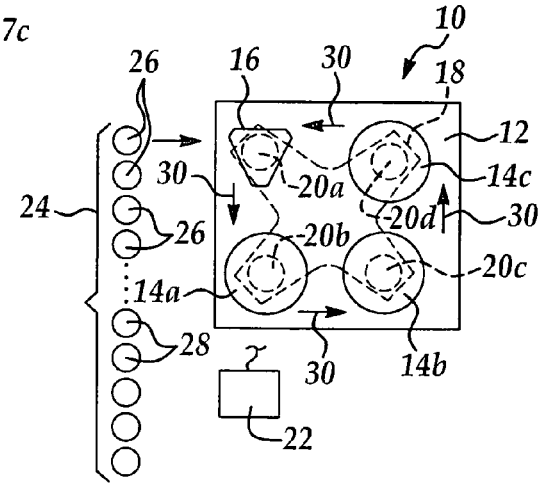
FIG. 6 is a schematic of a CMP apparatus, in implementation of the method of the present invention.

Referring to FIG. 6, the one-time feedback CMP process control method of the present invention is carried out typically using a conventional CMP apparatus 10. The CMP apparatus 10 may include a base 12 on which is provided a first polishing platen 14*a*, a second polishing platen 14*b* and a third polishing platen 14*c*. A head rotation unit 18 is provided above the base 12. A first polishing head 20*a*, a second polishing head 20*b*, a third polishing head 20*c* and a fourth polishing head 20*d* are provided on the head rotation unit 18. A load cup 16 is provided on the base 12 for the loading of wafers onto and from the polishing heads 20*a*–20*d*. A CLC controller 22 is operably connected to the polishing platens 14*a*–14*c* and the polishing heads 20*a*–20*d* to control the polish time as well as polish pressure and other variables of each polishing step. It is understood that the method of the present invention may be equally adaptable to CMP apparatus of alternative design.

Figure 3:
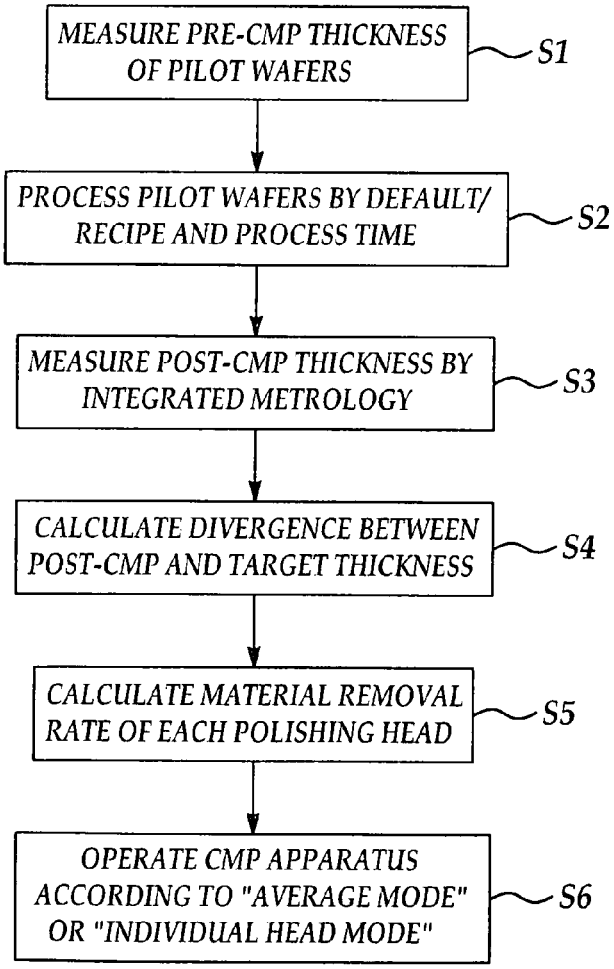
FIG. 3 is a flow diagram illustrating sequential process steps in the calculation of the post-CMP/target thickness divergence for each of multiple pilot wafers in a lot and the material removal rate for each of multiple polishing heads in a CMP apparatus, preparatory to operating the CMP apparatus in an "average mode" or an "individual head mode" according to the process of the present invention.

Referring next to FIGS. 3 and 6, according to the method of the present invention, the divergence between the post-CMP thickness and the target thickness of each of multiple pilot wafers 26 in a wafer lot 24 is initially determined. This is carried out by initially measuring the pre-CMP thickness of each of the pilot wafers 26, as indicated in step S1 of FIG. 3, typically using a conventional metrology tool suitable for the purpose. Although four pilot wafers 26 are shown in the wafer lot 24 of FIG. 6, it is understood that fewer or greater than four pilot wafers 26 may be used for the purpose. Preferably, at least two pilot wafers 26 are used.

The wafer lot 24 includes about 5~50 wafers. Typically, the wafer lot 24 includes about 25 wafers. Alternatively, the method of the present invention can be carried out using a batch of wafers, with each batch having typically about 40~500 wafers.

After the pre-CMP thickness of each pilot wafer 26 has been measured, the pilot wafers 26 are individually mounted on the respective polishing heads 20*a*–20*d* by operation of the load cup 16. As indicated in step S2 of FIG. 3, using a standard or given (feedfoeward by pre-process) default polishing recipe, each of the pilot wafers 26 is then sequentially polished on the respective first polishing platen 20*a*, second polishing platen 20*b* and third polishing platen 20*c*, as the head rotation unit 18 is re-positioned after each polishing step, in the direction indicated by the arrows 30. Accordingly, each pilot wafer 26 remains on the same polishing head 20*a*–20*d* throughout the polishing sequence. After completion of the polishing sequence, the post-CMP thickness of each pilot wafer 26 is measured, typically using conventional metrology techniques, as indicated in step S3.

As indicated in step S4, the divergence (D), or difference, between the target thickness and the post-CMP thickness of each pilot wafer is then determined. The material removal rate (R) of each polishing head 20*a*–20*d* on the CMP apparatus 10 is also determined (step S5). This is calculated by subtracting the post-CMP thickness from the pre-CMP thickness of each pilot wafer, and then dividing that value by the total polishing time. By use of the calculated values for the divergence (D) between the target thickness and the post-CMP thickness of each pilot wafer, and the material removal rate (R) of each polishing head 20*a*–20*d*, the CMP apparatus 10 can then be operated according to either the "average mode" or the "individual head mode", as hereinafter described.

Figure 4:
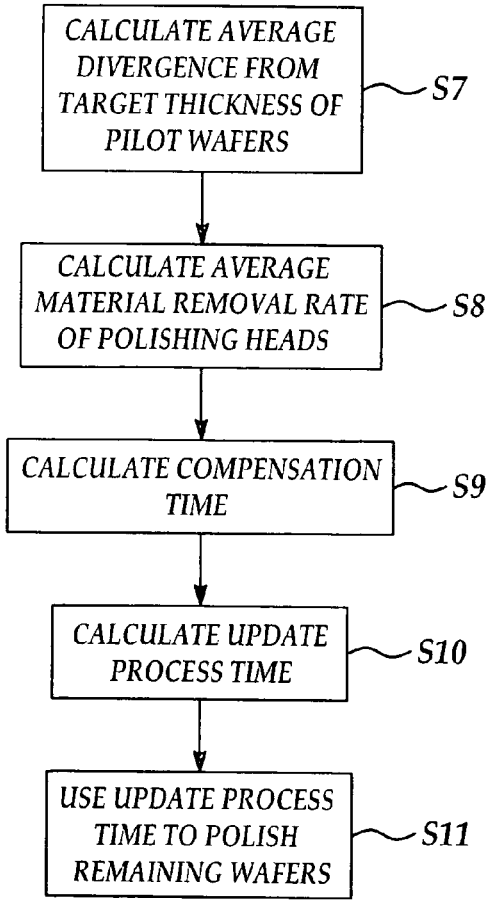
FIG. 4 is a flow diagram illustrating sequential process steps in the operation of a CMP apparatus according to the "average mode" of the method of the present invention.

The CMP apparatus 10 is operated according to the "average mode" typically as shown in the flow chart of FIG. 4. This is carried out by initially calculating the average divergence ($D_{avg}$) of the pilot wafers from the target thickness of the wafers, as indicated in step S7, as well as the average material removal rate ($R_{avg}$) of the polishing heads (step S8). A compensation time (Com-T) is then calculated (step 9), according to the following formula:

$$Com\text{-}T=(D_{avg})/(R_{avg})*k,$$

where Com-T is the compensation time, $D_{avg}$ is the average divergence of the pilot wafers from the target thickness of the wafers, $R_{avg}$ is the "average material removal rate of the polishing heads, and k is the compensation correction experimental factor which is correlated to layout, pattern density and integration process such as trench depth, sub-layer thickness . . . etc.

As indicated in step S10, an update process time ($T_U$) is then calculated by adding the compensation time to the original process time, according to the following formula:

$$T_U=T_o+com\text{-}T,$$

where $T_U$ is the update process time, $T_o$ is the original process time and com-T is the compensation time calculated at step S9.

As indicated in step S11, the remaining wafers 28 in the wafer lot 24 are then polished using the update process time ($T_o$) calculated at step S10, by operation of the CLC controller 22.

Figure 5:
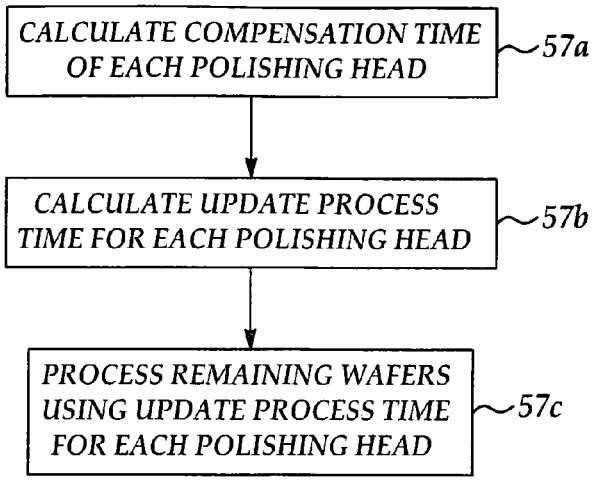
FIG. 5 is a flow diagram illustrating sequential process steps in the operation of a CMP apparatus according to the "individual head" mode of the present invention.

The CMP apparatus 10 is operated in the "individual head mode" typically as shown in the flow chart of FIG. 5. The "individual head mode" is an alternative to the "average mode" outlined above with respect to FIG. 4. As indicated in step S7*a*, the compensation time (Com-$T_i$) for each polishing head 20*a*–20*d* is initially calculated according to the following formula:

$$Com\text{-}T_i=(Davg_i)/(Ravg_i)*k_i,$$

where $Davg_i$ is the average divergence between the post-CMP thickness and the target thickness of the plural wafers polished using each polishing head (calculated according to step S4 in FIG. 3), $R_i$ is the material removal rate of each polishing head (calculated according to step S5 in FIG. 3), and $k_i$ is the compensation correction experimental factor of each polish carrier which is correlated to layout, pattern density, head construction and integration process such as trench depth, sub-layer thickness . . . etc.

As indicated in step S7*b*, an update process time for each polishing head is then calculated by adding the compensation time to the original process time, according to the following formula:

$$T_{Ui}=T_{oi}+com\text{-}T_i,$$

where $T_{Ui}$ is the update process time for each polishing head, $T_{oi}$ is the original process time for each polishing head and com-T is the compensation time for each polishing head, calculated at step 7*a*. As indicated in step S7*c*, the remaining wafers 28 in the wafer lot 24 are then processed using the update process time ($T_{Ui}$) calculated for each corresponding polishing head 20*a*–20*d* in the CMP apparatus 10. Accordingly, the CLC controller 22 controls each polishing head 20*a*–20*d* according to the update process time calculated for that polishing head, throughout the polishing sequence for the remaining wafers 28.

In a preferred embodiment, the CLC controller 22 is provided with supporting software to implement steps S1–S6 of FIG. 3, as well as a selector option between the "average mode" of FIG. 4 and the "individual head mode"

of FIG. 5 and the capability to carry out the sequential process steps of each, according to the knowledge of those skilled in the art.

Figure 7:
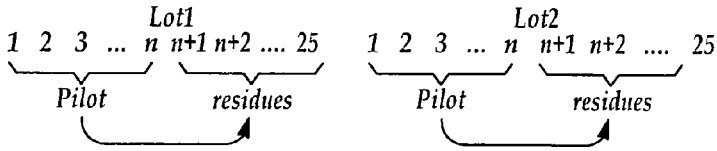
FIG. 7 is a numerical depiction of successive wafers in two wafer lots, illustrating implementation of the method of the present invention according to a lot-based mode.

Referring next to FIG. 7, the CMP apparatus 10 can be operated according to a lot-based mode using either the "average mode" of FIG. 4 or the "individual head mode" of FIG. 5. According to the lot-based mode, the multiple pilot wafers 26 in the wafer lot 24 are used to calculate the compensation time for the "average mode", as detailed herein above with respect to FIG. 4, or the "individual head mode", as detailed herein above with respect to FIG. 5. The compensation time is then implemented for the remaining wafers 28 in the wafer lot 24. Upon CMP processing of a new wafer lot 24, pilot wafers 26 from that lot 24 are then used to calculate a new compensation time only for the remaining wafers 28 in the lot 24, and another compensation time is calculated for the wafers 24 in the next lot 24.

Figure 8:
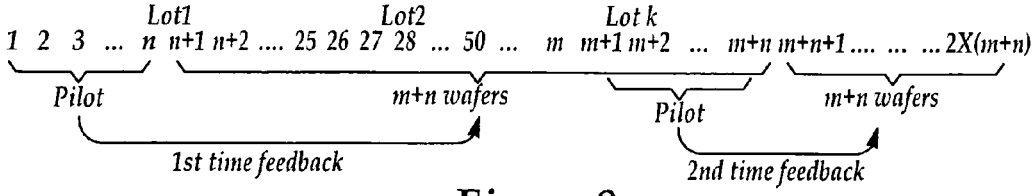
FIG. 8 is a numerical depiction of successive wafers in multiple wafer lots, illustrating implementation of the method of the present invention according to a continuing mode.

Referring next to FIG. 8, the CMP apparatus 10 can be operated according to a continuation mode. Multiple pilot wafers 26 in a wafer lot 24 are used to calculate the compensation time for the "average mode" or the "individual mode", which is implemented both for the remaining wafers 28 in that lot and for some or all of the wafers in the succeeding lot. A new compensation time is periodically calculated after numerous wafers in successive lots have been processed. The pilot wafers for the new compensation time may be selected from the beginning, middle or end of a lot.

Figure 1:
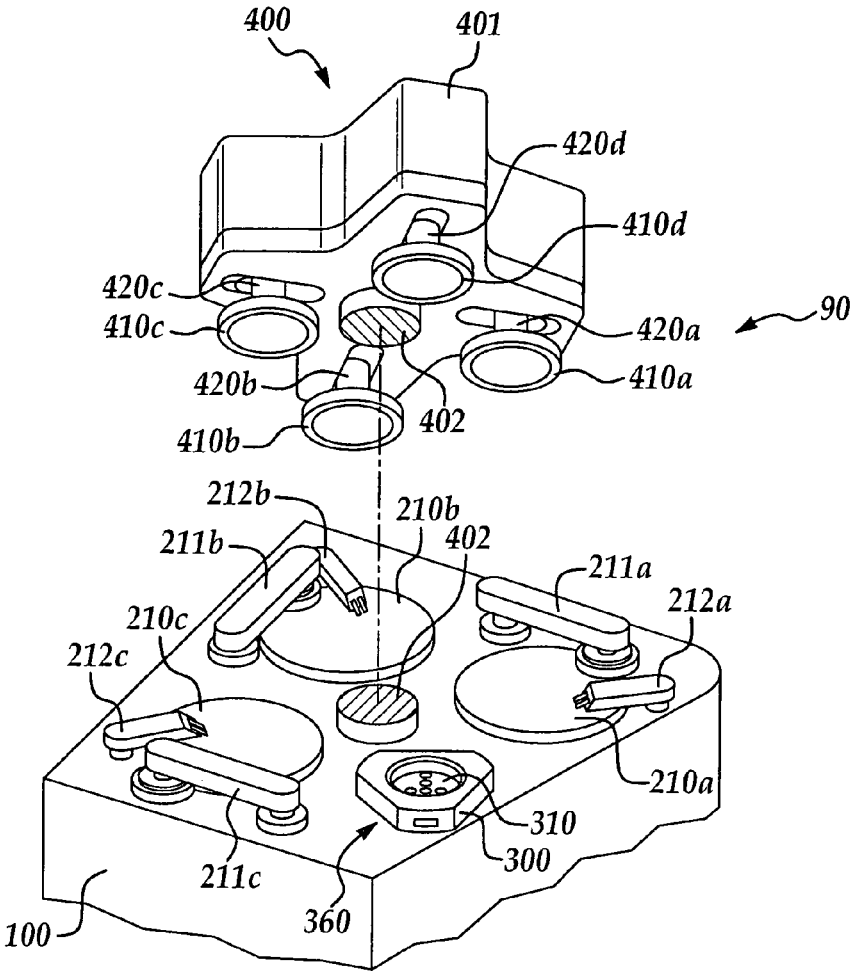
Figure 1 Prior Art
FIG. 1 is a perspective view of a typical conventional chemical mechanical polishing apparatus for the simultaneous polishing of multiple wafers.
Figure 1A:
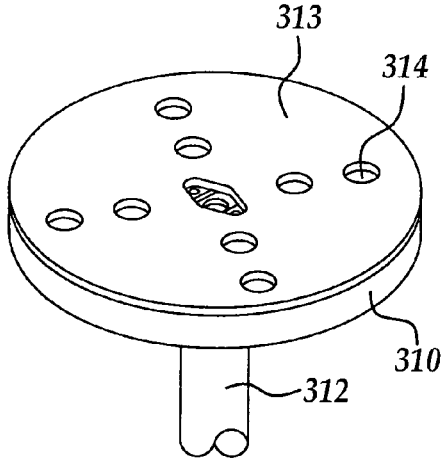
Figure 1A Prior Art
FIG. 1A is a top perspective view, partially in section, of a conventional pedestal assembly of the CMP apparatus of FIG. 1.
Figure 2:
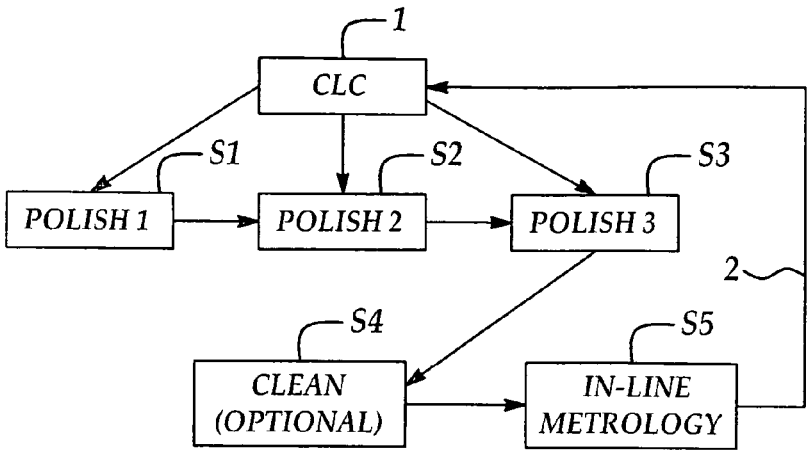
Figure 2 Prior Art
FIG. 2 is a flow diagram illustrating a conventional, continuous process time feedback configuration for the CMP processing of multiple wafers.
Figure 9:
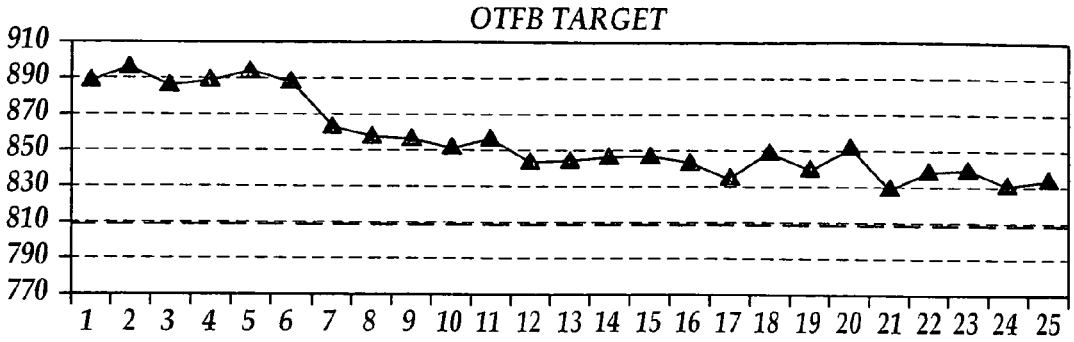
FIG. 9 is a graph, wherein the post-CMP thickness of each of multiple wafers in a wafer lot, obtained using the conventional, continuous process time feedback configuration, is compared to the post-CMP thickness of each of the wafers obtained using the one-time feedback CMP process control method of the present invention.

Referring next to FIG. 9, a graph is shown wherein post-CMP thickness of each of multiple wafers in a lot, as a result of two separate CMP processes, is plotted against the individual successive wafers, by number, in the lot. A CMP process in which was implemented the conventional, continuous feedback mechanism, heretofore described with respect to FIG. 2, is shown FIG. 901. A CMP process in which was implemented the single-feedback CMP process control method of the present invention is shown FIG. 9-2.

The target thickness of each of the CMP processes, the results of which are shown in FIG. 9, was 840 angstroms. It can be seen from the graph that the one-time feedback mechanism of the present invention results in a post-CMP thickness which much more closely approximates the target thickness, as compared to the conventional continuous feedback mechanism.

Figure 10:
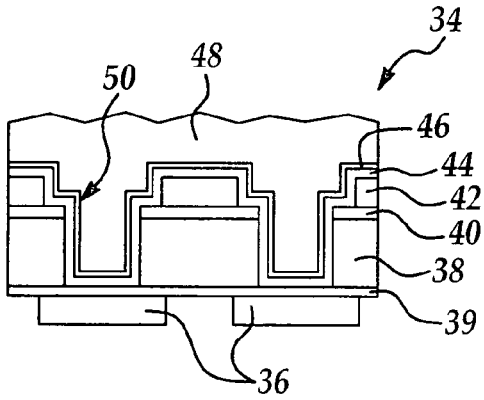
FIG. 10 is a cross-section of a dual-damascene structure suitable for implementation of the CMP process control method of the present invention.

Referring next to FIG. 10, the CMP process control method of the present invention is suitable for the chemical mechanical planarization of a metal layer 48 in a dual-damascene structure 34. The dual damascene structure 34 typically includes a first cap layer 39 deposited on a conducting layer 36, then followed by first dielectric layer 38 deposited above it. An etch stop layer 40 deposited on the first dielectric layer 38, and a second dielectric layer 42 deposited on the etch stop layer 40 can also be included in the structure. Each of one or more trenches 50 is lined with a barrier layer 44, and a seed layer 46 lines the barrier layer 44. The metal layer 48 fills the trench or trenches 50.

The metal layer 48 is typically tungsten, copper or aluminum, or an alloy of these metals. Each trench 50 has a depth of from typically about 1000 angstroms to about 3 $\mu$m. The first dielectric layer 38 and the second dielectric layer 42 each is typically a low dielectric material such as FSG, BD, silk or HSQ. The barrier layer 44 may be any suitable metal or material such as Ta, TaN or TiN. The cap layer 40 may be any suitable material such as SiN, SiC or N free ARC.

Figure 11:
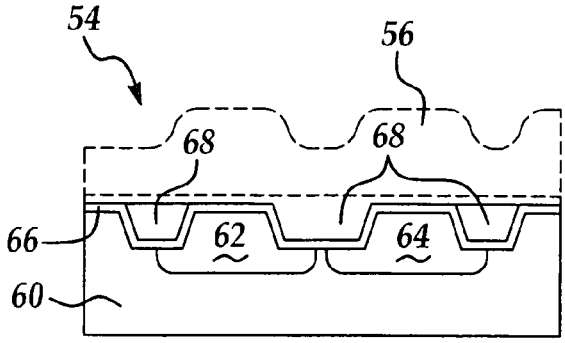
FIG. 11 is a cross-section of an STI (shallow trench isolation) structure suitable for implementation of the CMP process control method of the present invention.

Referring next to FIG. 11, the CMP process control method of the present invention is suitable for planarizing an oxide layer 56 on an STI (shallow trench isolation) structure 54. The STI structure 54 includes a p+ type silicon substrate or epi. A trench oxide 68, lined by a liner oxide 66, separates an n-well 62 from a p-well 64. The oxide layer 56 has a thickness of typically about 2,000~15,000 angstroms. Each trench oxide 68 has a depth of typically about 1,000~10,000 angstroms.

While the preferred embodiments of the invention have been described above, it will be recognized and understood that various modifications can be made in the invention and the appended claims are intended to cover all such modifications which may fall within the spirit and scope of the invention.

What is claimed is:

1. A CMP process control method, comprising the steps of:

providing a plurality of wafers having a set of pilot wafers and a set of remaining wafers;

polishing each of said pilot wafers according to an original process time;

determining a compensation time for said pilot wafers;

determining an update time by adding said compensation time to said original process time; and polishing said set of remaining wafers according to said update time.

2. The method of claim 1 wherein said set of pilot wafers comprises at least two pilot wafers.

3. The method of claim 1 wherein said plurality of wafers comprises a wafer lot having from about 5 to about 50 wafers.

4. The method of claim 1 wherein said plurality of wafers comprises a wafer batch having from about 40 to about 500 wafers.

5. The method of claim 1 wherein each of said plurality of wafers comprises a shallow trench isolation structure including an oxide layer having a thickness of from about 2000 angstroms to about 15000 angstroms and a trench oxide depth of from about 1000 to about 1000 angstroms.

6. The method of claim 1 wherein said polishing each of said pilot wafers according to an original process time comprises oxide buff polishing of each of said pilot wafers.

7. The method of claim 1 wherein said determining a compensation time comprises the steps of:

measuring rates of material removal from said pilot wafers, respectively;

measuring divergences between a target thickness and post-polishing thicknesses of said pilot wafers, respectively;

calculating an average of said rates of material removal and calculating an average of said divergences;

calculating a quotient by dividing said average of said divergences by said average of said rates of material removal; and multiplying said quotient by a compensation correction factor.

8. The method of claim 1 wherein said polishing each of said pilot wafers according to an original process time comprises polishing said pilot wafers at first, second, third and fourth polishing heads, respectively, of a CMP apparatus, and wherein said determining a compensation time comprises determining a compensation time for each of said polishing heads by:

measuring a rate of material removal from said pilot wafers at said first, second, third and fourth polishing heads, respectively;

measuring a divergence between a target thickness and a post-polishing thickness of said pilot wafers at said first, second, third and fourth polishing heads, respectively;

calculating a quotient for each of said polishing heads by dividing said divergence by said rate of material removal at each of said polishing heads; and multiplying said quotient by a compensation correction factor.

9. A CMP process control method for a CMP apparatus having a plurality of polishing heads and a closed-loop controller, comprising the steps of:

providing a plurality of wafers having a set of pilot wafers and a set of remaining wafers;

polishing said pilot wafers on said polishing heads, respectively, according to an original process time;

determining a compensation time for said pilot wafers;

determining an update time by adding said compensation time to said original process time; and polishing said set of remaining wafers by causing said controller to actuate said polishing heads according to said update time.

10. The method of claim 9 wherein said set of pilot wafers comprises at least two pilot wafers.

11. The method of claim 9 wherein said plurality of wafers comprises a wafer lot having from about 5 to about 50 wafers.

12. The method of claim 9 wherein said plurality of wafers comprises a wafer batch having from about 40 to about 500 wafers.

13. The method of claim 9 wherein each of said plurality of wafers comprises a shallow trench isolation structure including an oxide layer having a thickness of from about 2000 angstroms to about 15000 angstroms and a trench oxide depth of from about 1000 to about 10000 angstroms.

14. The method of claim 9 wherein said polishing each of said pilot wafers according to an original process time comprises oxide buff polishing of each of said pilot wafers.

15. The method of claim 9 wherein said determining a compensation time comprises the steps of:

measuring rates of material removal from said pilot wafers, respectively;

measuring divergences between a target thickness and post-polishing thicknesses of said pilot wafers, respectively;

calculating an average of said rates of material removal and calculating an average of said divergences;

calculating a quotient by dividing said average of said divergences by said average of said rates of material removal; and multiplying said quotient by a compensation correction factor.

16. The method of claim 9 wherein said polishing each of said pilot wafers according to an original process time comprises polishing said pilot wafers at first, second, third and fourth polishing heads, respectively, of a CMP apparatus, and wherein said determining a compensation time comprises the steps of:

measuring a rate of material removal from said pilot wafers at said first, second, third and fourth polishing heads, respectively;

measuring a divergence between a target thickness and a post-CMP thickness of said pilot wafers at said first, second, third and fourth polishing heads, respectively;

calculating a quotient for each of said polishing heads by dividing said divergence by said rate of material removal at each of said polishing heads; and multiplying said quotient by a compensation correction factor.

17. A CMP process control method for a metal CMP process, comprising the steps of:

providing a plurality of wafers having a set of pilot wafers and a set of remaining wafers, each of said plurality of wafers having a substrate and a metal layer provided on said substrate;

polishing said metal layer on each of said pilot wafers according to an original process time;

determining a compensation time for said pilot wafers;

determining an update time by adding said compensation time to said original process time; and polishing said metal layer on said set of remaining wafers according to said update time.

18. The method of claim 17 wherein said determining a compensation time comprises the steps of:

measuring rates of material removal from said metal layer on said pilot wafers, respectively;

measuring divergences between a target thickness and post-polishing thicknesses of said pilot wafers, respectively;

calculating an average of said rates of material removal and calculating an average of said divergences;

calculating a quotient by dividing said average of said divergences by said average of said rates of material removal; and multiplying said quotient by a compensation correction factor.

19. The method of claim 17 wherein said polishing said metal layer on each of said pilot wafers according to an original process time comprises polishing said metal layer on each of said pilot wafers at first, second, third and fourth polishing heads, respectively, of a CMP apparatus, and wherein said determining a compensation time comprises determining a compensation time for each of said polishing heads by:

measuring a rate of material removal from said metal layer on said pilot wafers at said first, second, third and fourth polishing heads, respectively;

measuring a divergence between a target thickness and a post-polishing thickness of pilot wafers at said first, second, third and fourth polishing heads, respectively;

calculating a quotient for said polishing heads by dividing said divergence by said rate of material removal at each of said polishing heads; and multiplying said quotient by a compensation correction factor.

20. The method of claim 17 further comprising a dual damascene structure provided in said metal layer, said dual damascene structure having a trench depth of from about 1000 angstroms to about 3 um a low-k dielectric layer provided adjacent to said metal layer; a barrier layer provided in said trench; and a seed layer provided on said barrier layer.

21. The method of claim 20 wherein said metal layer is a metal selected from the group consisting of tungsten, copper, aluminum and alloys of tungsten, copper and aluminum.

22. The method of claim 20 wherein said barrier layer is a material selected from the group consisting of Ta, TaN and Tin.

23. The method of claim 20 wherein said low-k layer is a dielectric selected from the group consisting of FSG, BD, SiLK and HSQ.

* * * * *